US005510142A

United States Patent [19]

Groshens

[11] Patent Number: 5,510,142

[45] Date of Patent: Apr. 23, 1996

[54] PROCESS FOR MANUFACTURING A COMPOSITE BASE FABRIC INTENDED FOR THE REINFORCEMENT OF A WAISTBAND AND COMPOSITE BASE FABRIC THUS OBTAINED

[75] Inventor: Pierrot Groshens, Peronne, France

[73] Assignee: Lainiere De Picardie, Peronne, France

[21] Appl. No.: 306,757

[22] Filed: Sep. 15, 1994

[30] Foreign Application Priority Data

Sep. 2, 1994 [FR] France ..... 94 10581

[51] Int. Cl.[6] ..... B05D 3/12; B05D 3/02; B05D 1/38; D06C 15/00

[52] U.S. Cl. ..... 427/176; 427/175; 427/316; 427/358; 427/366; 427/377; 427/381; 427/412

[58] Field of Search ..... 427/381, 389.9, 427/412, 2.31, 175, 176, 358, 365, 366, 377, 316

[56] References Cited

U.S. PATENT DOCUMENTS

| | | | |
|---|---|---|---|
| 3,178,498 | 4/1965 | Brannock | 427/377 |
| 3,571,814 | 3/1971 | Miller | 2/236 |
| 3,590,390 | 7/1971 | Howard et al. | 264/257 |
| 3,911,698 | 10/1975 | Walford | 66/84 A |
| 3,948,702 | 4/1976 | Theissen | 427/412 |
| 3,983,870 | 10/1976 | Herbert et al. | 427/243 |
| 4,052,521 | 10/1977 | Ferrari | 427/176 |
| 4,076,098 | 2/1978 | Ward | 427/412 |
| 4,244,199 | 1/1981 | Rhode | 66/193 |
| 4,288,212 | 9/1981 | Vertegaal | 427/381 |
| 4,427,107 | 1/1984 | Roberts et al. | 198/844 |
| 4,705,710 | 11/1987 | Matsuda | 428/92 |
| 4,737,400 | 4/1988 | Edison et al. | 427/381 |
| 4,818,316 | 4/1989 | Weinle et al. | 156/88 |
| 4,828,909 | 5/1989 | Davis et al. | 427/396 |
| 5,156,589 | 10/1992 | Langen et al. | 427/2.31 |
| 5,215,807 | 6/1983 | Day et al. | 428/193 |
| 5,290,594 | 3/1994 | Groghens et al. | 427/381 |
| 5,382,445 | 1/1995 | Yasis | 427/2.31 |

*Primary Examiner*—Diana Dudash

*Attorney, Agent, or Firm*—Kane, Dalsimer, Sullivan, Kurucz, Levy, Eisele and Richard

[57] ABSTRACT

The invention concerns a process for manufacturing a composite base fabric intended for the reinforcement of a waistband which is elastic in the direction of the warp, characterized in that it comprises the steps of using a warp knitting machine with weft inserts to produce a composite base fabric comprising a warp knit fabric, a fabric substrate inserted in the warp knit fabric, elastic yarns which undergo a tensional elastic deformation during the knitting, weft yarns; thermofixing the composite base fabric thus obtained; depositing a film forming coating comprising a cross-linkable resin on the face of the fabric substrate in contact with the elastic yarns and the weft yarns; drying and cross-linking the film forming coating; submitting the composite base fabric to a relaxation treatment

26 Claims, 2 Drawing Sheets

PROCESS FOR MANUFACTURING A COMPOSITE BASE FABRIC INTENDED FOR THE REINFORCEMENT OF A WAISTBAND AND COMPOSITE BASE FABRIC THUS OBTAINED

FIELD OF THE INVENTION

The invention concerns a process for manufacturing a composite base fabric intended for the reinforcement of an elastic waistband mainly intended for skirts or trousers. The invention also concerns the composite base fabric obtained through this process.

BACKGROUND OF THE INVENTION

The use of knitted base fabrics of large widths to reinforce waistbands or to increase their rigidity using the warp (or tricot) technique with long, synthetic monofilament weft inserts has already been described (EP-A-0 161 823).

These knitted base fabrics are cut in small strips corresponding to the width required to reinforce the waistband.

This type of base fabric has a certain number of disadvantages.

A first disadvantage is that the monofilament wefts cannot be correctly attached to the warp knitted fabric structure made up of multifilament yarns due to the fact that the binding points are very small and that the adhesion between the smooth filament yarns (monofilament or multifilament) is hazardous and disappears as a result of the mechanical and chemical treatments undergone during washing and dry-cleaning. As a result, the monofilament yarns come out of the structure and pass through the cloth of the waistband.

Another disadvantage of this type of knitted base fabric which is worth mentioning is that, given the spacing of the monofilament yarns (separated by the knots in the stitch), the selvedges of the cut strips have an abrasive surface.

To avoid these disadvantages it is necessary to deposit on both selvedges of the strip a continuous wad of synthetic resin covering the abrasive end of the monofilament yarns.

As a reinforcement for the waistband, it is also possible to use a composite fabric consisting of a nonwoven fabric knitted inside a long weft stitch (U.S. Pat. No. 4,980,930).

The purpose of the nonwoven fabric is to even and smoothen the surface of one of the fabric's faces. This even surface makes it possible to eliminate the necessity for a protective or screen forming fabric in the waistband. This specific configuration simplifies the fitting of the waistband and reduces its cost.

However, the two base fabrics described above have little or no elasticity in the direction of the warp, as this can only be obtained with highly elastic yarns.

For this purpose, it has been suggested that composite waistbands be used which are elastic in the direction of the warp and manufactured in small widths (waistband width of approximately 1.54 to 2.3 cm) using the knitting-crochet technique (U.S. Pat. No. 4,551,994).

The base fabric described in this document essentially consists of:

- a warp knit fabric substrate made up of synthetic multifilament yarns, with elastic yarns deposited substantially parallel to the wales (in the direction of the warp);

- a monofilament yarn deposited on part of the width of the waistband by means of a pattern bar equipped with guides between the rows of short "weft" stitches; this monofilament yarn ensures rigidity in the direction of the width;
- a second multifilament weft yarn deposited in a strip parallel to that comprising the monofilament wefts;
- a multifilament yarn layer deposited in the form of a very short weft whose purpose is to form a screen and possibly patterns.

The main purpose of this multilayer base fabric is to simplify the fitting of the waistband. However, it has major disadvantages such as:

- the high manufacturing cost of the knitting;
- the finishing treatments (stabilization with a coating finish) performed in small widths;
- the yarn numbering of the monofilament yarns required for the purpose of rigidity and deposited using the warp pattern bar technique, which is limited in terms of thickness due to the fact that the yarn is necessarily folded back upon each to-and-fro passage inside the reinforced strip.

SUMMARY OF THE INVENTION

With the foregoing in mind, it is an object of the present invention is therefore to propose a composite base fabric intended for the reinforcement of waistbands which eliminates the disadvantages or limitations of such substrates in prior art. More specifically, the goal of the present invention is to propose a composite base fabric intended for the reinforcement of waistbands which is elastic in the direction of the warp, produced in large widths using the warp technique with weft inserts throughout the length of the fabric, and furthermore comprising or capable of comprising a nonwoven lap incorporated and knitted simultaneously.

Another object of the present invention is to propose a composite base fabric of this type rigid enough to be cut.

Another object of the present invention is to propose a composite base fabric of this type where the monofilament weft yarn in the waistband is highly resistant. In other words, another object of the present invention is to propose a composite base fabric in which there is no risk for the monofilament yarn to come out-of the structure in the course of the mechanical and chemical treatments undergone when used (washing, drying, ironing, dry cleaning, etc.).

Another object of the present invention is to propose a composite base fabric with which it is not necessary to weld the edges of the fabric since the monofilament yarn is always held in place.

The invention thus concerns a process for manufacturing a composite base fabric intended for the reinforcement of a waistband which is elastic in the direction of the warp, characterised in that it comprises the following steps:

- a using a warp knitting machine with weft inserts to produce a composite base fabric comprising:
  - a warp knit fabric;
  - a fabric substrate inserted in the warp knit fabric;
  - elastic yarns which undergo a tensional elastic deformation during the knitting, the said elastic yarns being inserted in the warp knit fabric substantially parallel to the wales according to a lap on one needle configuration;
  - long weft yarns inserted in the warp knit fabric without participating in the formation of its stitches;

thermofixing the composite base fabric thus obtained so as to avoid its shrinkage upon subsequent thermal treatments;

depositing a film forming coating comprising a cross-linkable resin on the face of the fabric substrate in contact with the elastic yarns and the weft yarns;

drying and cross-linking the film forming coating to ensure the fixing of the weft yarns on the fabric substrate;

submitting the composite base fabric to a relaxation treatment in order to slacken the elastic yarns and to eliminate the residual tensions which have possibly appeared in the course of the previous steps.

According to another characteristic of the invention, the fabric substrate is a nonwoven lap and/or a knitted yarn layer in the form of a short weft with laps on at least two needles.

The tensional elastic deformation of the elastic yarns is obtained using a feeding rate for these yarns inferior by 20 to 150% or more to the feeding rate of the fabric substrate; the tensional elastic deformation can thus be of approximately 15 to 100% with respect to their initial position.

These elastic yarns are elastothanic and can consist of mono or multifilament yarns possibly wrapped with a second covering yarn.

According to another characteristic of the invention, after the drying and cross-linking of the film forming coating step and before the relaxation step, points of thermofusible copolymers are deposited on the composite base fabric and these points of thermofusible copolymers are dried and/or melted by means of an oven.

The invention also concerns a composite base fabric intended for the reinforcement of a waistband which is elastic in the direction of the warp, characterised in that it comprises:

a warp knit fabric;

a fabric substrate inserted in the warp knit fabric;

elastic yarns inserted substantially parallel to the wales according to a lap on one needle configuration;

long weft yarns inserted in the warp knit fabric without participating in the formation of its stitches;

a film forming coating on the face of the fabric substrate in contact with the elastic yarns and the weft yarns.

BRIEF DESCRIPTION OF THE DRAWINGS

Further characteristics and advantages of the present invention will be clearly understood upon reading the description which follows and which refers to the attached drawings listed below.

DESCRIPTION OF THE ILLUSTRATED EMBODIMENTS

Figure 5:
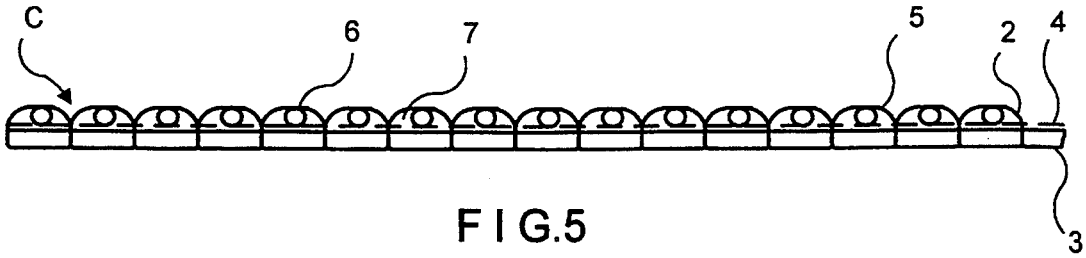
FIG. 5 is a cross-sectional diagram of the composite base fabric according to the invention following the depositing of a film forming coating step of the process conforming to the present invention.
Figure 7:
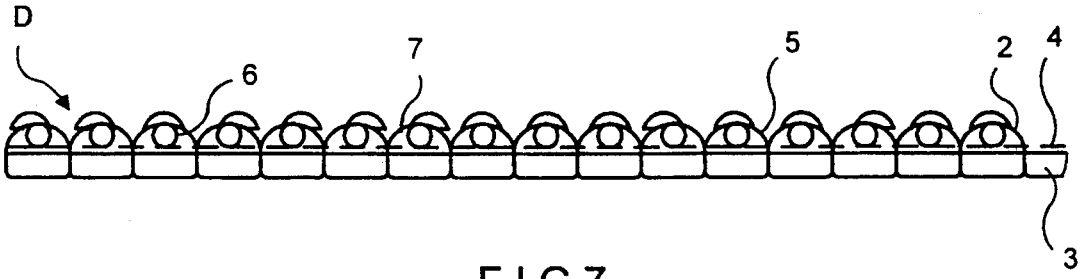
FIG. 7 is a cross-sectional diagram of the composite base fabric according to the invention following the depositing of points of thermofusible copolymers step of the process conforming to the present invention.
Figure 9:
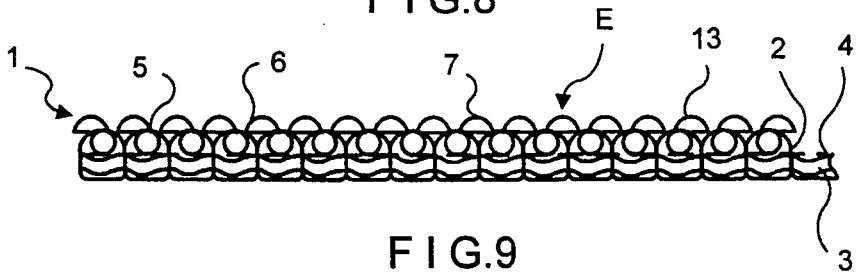
FIG. 9 is a cross-sectional diagram of the composite base fabric according to the invention following the relaxation treatment step of the process conforming to the present invention, in the alternate embodiment where it comprises points of thermofusible copolymers.

In the description which follows, the letters A, B, C, D, E represent the structure of the composite base fabric in the main steps of the manufacturing process conforming to the present invention. In other words, the letter A (FIG. 1) represents the composite base fabric with the structure it displays following the knitting step of the process according to the invention, letter B (FIG. 3) represents the composite base fabric with the structure it displays following the thermofixing step of the process according to the invention, letter C (FIG. 5) represents the composite base fabric with the structure it displays following the depositing of a film forming coating step of the process according to the invention, letter D (FIG. 7) represents the composite base fabric following the optional depositing of points of thermofusible copolymers step of the process according to the invention and, finally, letter E (FIG. 9) represents the composite base fabric with the structure it displays following the relaxation treatment step of the process according to the invention.

In the figures showing diagrams of the steps of the process according to the invention (FIGS. 2, 4, 6, 8), the letters A to E represent the structure displayed by the composite base fabric according to the invention at the different stages of the process.

Figure 1:
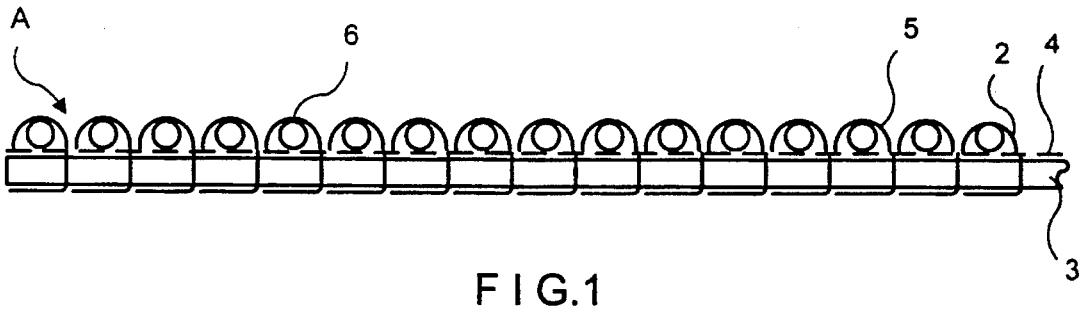
FIG. 1 is a cross-sectional diagram of a composite base fabric according to the invention following the knitting step of the process conforming to the present invention.
Figure 2:
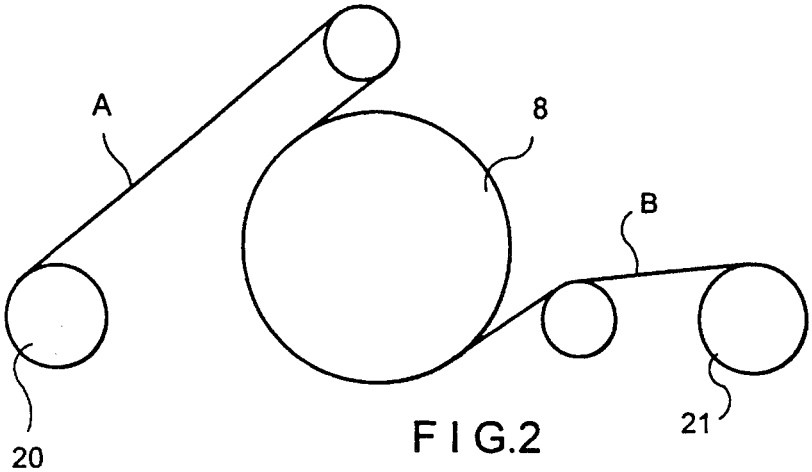
FIG. 2 is a diagram of the thermofixing step of the process conforming to the present invention.
Figure 3:
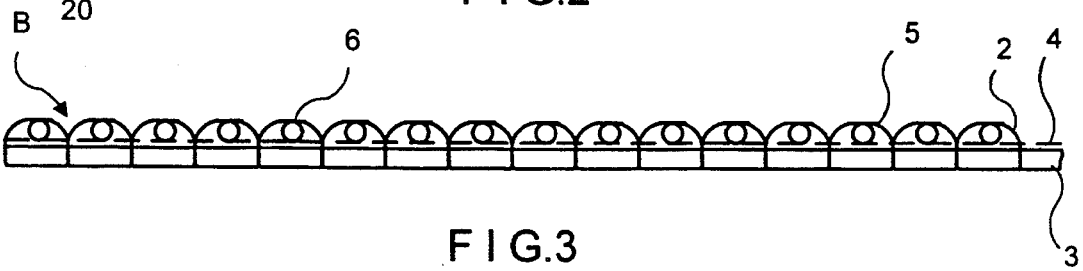
FIG. 3 is a cross-sectional diagram of a composite base fabric according to the invention following the thermofixing step of the process conforming to the present invention.
Figure 4:
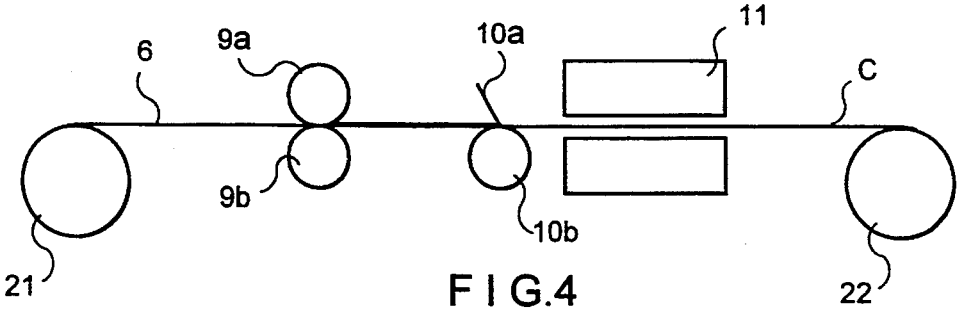
FIG. 4 is a diagram of the depositing of a film forming coating step of the process conforming to the present invention.

Therefore, as an example, in FIG. 2 the letter A indicates that the composite base fabric displays the structure of FIG. 1 and the letter B indicates that the composite base fabric displays the structure illustrated in FIG. 3.

The invention thus concerns a process for manufacturing a composite base fabric 1 intended for the reinforcement of a waistband. This composite base fabric is elastic in the direction of the warp. According to the invention, a composite base fabric is manufactured by carrying out five main steps:

(a) a knitting of the composite base fabric step, (b) a thermofixing of the composite base fabric step, (c) a depositing of a film forming coating step, (d) a drying and cross-linking of the film forming coating step, (e) a relaxation treatment of the composite base fabric step.

(a) The knitting of the composite base fabric step

According to the invention, a warp knitting machine with weft inserts is used to produce a composite base fabric 1 comprising:

(i) A warp knit fabric 2 forming stitches 5. This warp knit fabric 2 is made up of mono or multifilament yarns with a yarn count of between approximately 33 Dtex and 200 Dtex.

(ii) A fabric substrate 3 inserted in the warp knit fabric 2, with this fabric substrate 3 possibly consisting, according to the invention, of a nonwoven lap and/or a knitted yarn layer in the form of a short weft with laps on at least two needles.

(iii) Elastic yarns 4 which undergo a tensional elastic deformation during the knitting. In other words, the elastic yarn 4 is stretched during the knitting of the composite base fabric 1 step, or the elastic yarn is lengthened during its insertion in the warp knit fabric 2. This insertion is performed substantially parallel to the wales 5 according to a lap on one needle configuration.

The tensional elastic deformation undergone by the elastic yarns 4 is obtained using a feeding rate for the elastic yarns 4 inferior by 20 to 150% or more to the feeding rate of the fabric substrate 3.

The elastic yarns 4 can consist of monofilament or multifilament yarns. Preferably, the elastic yarns 4 are chosen from amongst those like to undergo a tensional elastic deformation of approximately 15 to 100% with respect to their initial position. In a preferred alternate embodiment, the elastic yarns 4 consist only of elastothane or of elastothane wrapped with a second covering yarn.

(iv) Long weft yarns 6 inserted in the warp knit fabric 2 without participating in the formation of its stitches 5. These weft yarns 6 can consist of monofilament or multifilament yarns, synthetic or artificial, and have a yarn count of between approximately 200 Dtex and 2500 Dtex.

(b) Thermofixing of the composite base fabric

From what has already been stated, it is understood that the knitting of the composite base fabric 1 is performed in a taut manner since the elastic yarns 4 have been inserted in an elongation or stretching position. The composite base fabric 1 thus obtained is tightly wound around the knitting input roller 22.

According to the invention, this composite base fabric 1 is thermofixed by passing it through a roller 8 heated to a high temperature of, for example, between 120° C. and 250° C.

The purpose of this thermofixing of the composite base fabric 1 step is to fix the length of the stitch yarns 5 in the warp knit fabric 2 so as to avoid its shrinkage upon subsequent thermal treatments.

This takes us to structure B of the composite base fabric 1 shown in FIG. 3, structure in which the composite base fabric according to the invention displays a more flattened configuration than following the knitting (FIG. 1). Such a configuration has the main advantage of slightly holding the weft yarns 6 within the structure of the composite base fabric 1 according to the invention.

(c) Depositing of the film forming coating

In the composite base fabric obtained following this thermofixing step, despite the fact that they are slightly held due to the thermofixing of the stitch yarns 5, the weft yarns 6 are presently unable to withstand the chemical and mechanical treatments which the clothing in which the composite base fabric of the invention is incorporated will be submitted to (washing, drying, ironing, dry cleaning, etc.).

To increase this necessary resistance, according to the invention, after passing the composite base fabric through a thermofixing input roller 21, a film forming coating 7 comprising a cross-linkable resin is deposited on the face of the fabric substrate 3 in contact with the elastic yarns 4 and the weft yarns 6. Thus, the weft yarns 6 and, partially, the stitch yarns 5 are coated with the film forming coating 7.

This depositing of the film forming coating 7 can be performed by means of a rotary frame **9*a* equipped with a counter-roller 9*b*, and a doctor knife or equivalent. It can then be flattened by passing the composite base fabric 1 between a doctor knife 10*a* and a counter-roller 10*b* in order to obtain a thickness of between a few micrometers and approximately 0.5 mm. This film forming coating 7 consists of an aqueous dispersion of paste, foam or equivalent. In a preferred alternate embodiment, according to the invention a foam medium dispersion is preferred in order to avoid an excessive penetration of the film forming coating 7 in the fabric substrate 3**.

As for the composition of the film forming coating 7, it comprises between 80 and 200 g/l of cross-linkable resin, between 15 and 40 g/l of catalyst, between 250 and 600 g/l of cross-linkable polyacrylic and/or crosslinkable polyurethane and/or a mixture of polyacrylic and polyurethane, and between 20 and 30 g/l of a polyvinyl acetate stiffening agent.

(d) Drying and cross-linking of the film forming coating

The film forming coating 7 thus deposited is dried and cross-linked to ensure the fixing of the weft yarns 6 on the fabric substrate 3 without piercing the fabric substrate 3 held inside the warp knit fabric 2. This drying and cross-linking of the film forming coating 7 is performed by heating the composite base fabric according to the invention in an oven 11 (at a temperature of between approximately 110° C. and 200° C., with the temperature selected according to time), following which the base fabric is received by a film forming coating 7 input roller 22. This takes us to the structure C of the composite base fabric 1 shown in FIG. 5. Once these film forming coating depositing and drying and cross-linking steps have been carried out, the weft yarns 6 cannot come out of the structure of the composite base fabric and pass through the cloth or clothing in which they have been incorporated in the course of mechanical and chemical treatments such as washing, drying, etc. It is therefore not necessary to either weld the edges of the composite base fabric or to deposit a continuous wad of synthetic resin covering the abrasive end of the weft yarns 6.

The film forming coating 7 has a somewhat elastic quality. As already indicated, it ensures the fixing of the weft yarns 6 inside the composite base fabric. Furthermore, it increases its stiffness, which is advantageous for the feel as well as for cutting it into strips in order to be integrated into clothing (trousers or skirts).

(e) Relaxation treatment of the composite base fabric

Figure 10:
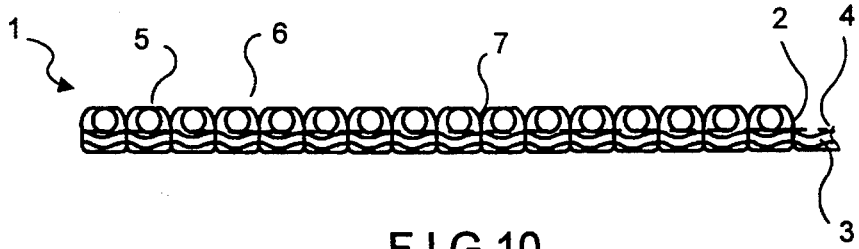
FIG. 10 is a cross-sectional diagram of a composite base fabric according to the invention following the relaxation treatment step of the process conforming to the present invention, in the alternate embodiment where it does not comprise points of thermofusible copolymers.

In steps (a) to (d), the elastic yarns 4 are always in stretched position. In order for the elastic yarns to play their role, i.e. to provide the composite base fabric 1 according to the invention with an elasticity in the direction of the warp the composite base fabric 1 is submitted to a relaxation treatment to slacken the elastic yarns 4 and to eliminate the residual tensions which have possibly appeared in the course of the previous steps of the process according to the invention. This relaxation treatment of the composite base fabric 1 consists of submitting it to a thermal shock or equivalent which can be achieved, for example, by means of a steam tunnel 15 (FIG. 8) whose temperature and steam delivery rate are determined so as to ensure a softening of the composite base fabric 1. As a suggestion, the temperature of the steam tunnel 15 can be of between 102° C. and 150° C. This takes us to the structure of the composite base fabric 1 according to the invention shown in FIG. 10, which does not include points of thermofusible copolymers.

Figure 6:
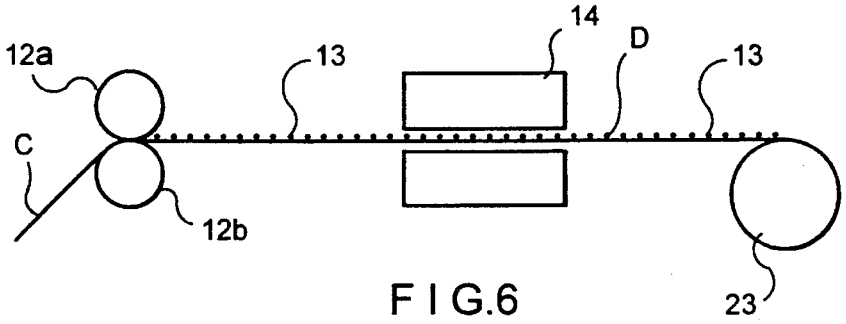
FIG. 6 is a diagram of the optional depositing and drying and/or melting of points of thermofusible copolymers step of the process conforming to the present invention.

In another alternate embodiment of the invention, after the drying and cross-linking of the film forming coating 7 step and before the relaxation step, points of thermofusible copolymers 13 are deposited on the composite base fabric 1 and these adhesive points 13 are dried and/or melted by means of an oven 14 (FIG. 6).

Figure 8:
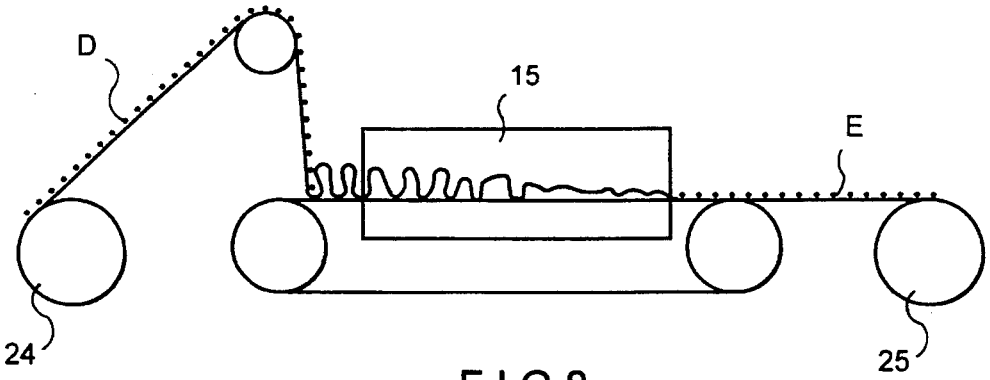
FIG. 8 is a diagram of the relaxation treatment step of the process conforming to the present invention.

These points of thermofusible copolymers 13 can be deposited by means of a screen printing machine 12*a* and its counter-roller 12*b* or photo-engraving. The composite base fabric 1 displays the structure D thus obtained and is received by a thermofusible copolymers output roller 23. Then, passing through a relaxation treatment input roller 24, the composite base fabric 1 is led towards the steam tunnel 15 which submits it to a thermal shock (FIG. 8). At the output of this steam tunnel, the composite base fabric 1 according to the invention is received by relaxation treatment output roller 25 and displays the structure E shown in FIG. 9.

The thermofusible copolymers can, as already known, be selected from amongst copolyamides, copolyesters and copolyethylenes with a melting temperature of between approximately 70° C. and 150° C.

If necessary, the process according to the invention allows for a step intended to flatten or level the composite base fabric 1. It can consist, for example, of calendering by means of a felt calender.

The composite base fabric thus obtained by means of the process according to the invention can then be cut into strips of a width allowing them to be used in waistbands (15 to 40 mm, for example).

The invention also concerns a composite base fabric 1 intended for the reinforcement of a waistband and which is elastic in the direction of the warp.

According to the invention and as already mentioned, such a composite base fabric 1 comprises a warp knit fabric 2; a fabric substrate 3 inserted in the warp knit fabric 2; elastic yarns 4 inserted substantially parallel to the wales 5 according to a lap on one needle configuration; long weft yarns 6 inserted in the warp knit fabric 2 without participating in the formation of its stitches 5; a film forming coating 7 on the face of the fabric substrate in contact with the elastic yarns 4 and the weft yarns 6.

According to an alternate embodiment of the invention, the composite base fabric 1 can further include points of thermofusible copolymers 13.

That which is claimed is:

1. A process for manufacturing a composite base fabric for the reinforcement of a waistband and which is elastic in the direction of the warp, which comprises:

A. knitting a composite base fabric comprising:
- (i) a warp knit fabric;
- (ii) a fabric substrate inserted in the warp knit fabric;
- (iii) elastic yarns under a tensional elastic deformation, said elastic yarns being inserted in the warp knit fabric substantially parallel to the fabric wales; and
- iv weft yarns inserted in the warp knit fabric without participating in the formation of its stitches;

B. thermofixing the composite base fabric;

C. depositing a film forming coating comprising a cross-linkable resin on the fabric substrate in contact with the elastic yarns and the weft yarns;

D. drying and cross-linking the film forming coating the fixing the weft yarns on the fabric substrate; and E. submitting the composite base fabric to a relaxation treatment to slacken the elastic yarns.

2. A process according to claim 1, wherein the fabric substrate is a nonwoven lap and/or a knitted yarn layer in the form of a weft with laps.

3. A process for manufacturing a composite base fabric for the reinforcement of a waistband and which is elastic in the direction of the warp, which comprises;

A. knitting
- (i ). a warp knit fabric;
- (ii). a fabric substrate inserted in the warp knit fabric;
- (iii ). elastic yarns which under a tensional elastic deformation said elastic yarns being inserted in the warp knit fabric substantially parallel to the fabric wales; and
- iv. weft yarns inserted in the warp knit fabric without participating in the formation of its stitches;

B. thermofixing the composite base fabric;

C. depositing a film forming coating comprising a cross-linkable resin on the fabric substrate in contact with the elastic yarns and the weft yarns;

D. drying and cross-linking the film forming coating fixing the weft yarns on the fabric substrate; and E. submitting the composite base fabric to a relaxation treatment to slacken the elastic yarns;

wherein during knitting the elastic yarns are submitted to a tensional elastic deformation by using a feeding rate for the elastic yarns less than the feeding rate of the fabric substrate insertion.

4. A process according to claim 3, wherein the feeding rate for the elastic yarns is less than 20 to 150% of the fabric substrate feed rate.

5. A process according to any of claims 1 to 4, wherein the elastic yarns are under a tensional elastic deformation of approximately 15 to 100%.

6. A process according to claim 1, wherein the elastic yarns are monofilament yarns.

7. A process according to claims 1, wherein the elastic yarns are multifilament yarns.

8. A process according to claim 3, wherein the warp knit fabric is made up of monofilament yarns.

9. A process according to claim 3, wherein the warp knit fabric is made up of multifilament yarns.

10. A process according to claim 8 or 9, wherein the yarns of the warp knit fabric have a yarn count of approximately 33 Dtex to 200 Dtex.

11. A process according to claim 3, wherein the weft yarns are monofilament yarns.

12. A process according to claim 3, wherein the weft yarns are multifilament yarns.

13. A process according to claim 11 or 12, wherein the weft yarns are synthetic.

14. A process according to claims 12 wherein the weft yarns have a yarn count of approximately 200 Dtex to 2200 Dtex.

15. A process according to claim 11 or 12, wherein the composite base fabric is thermofixed by passing it through a roller heated to a temperature of between approximately 120° C. and 250° C.

16. A process according to claim 3, wherein the film forming coating is deposited by means of a rotary frame and a doctor knife.

17. A process according to claim 16, wherein the film forming coating is flattened after being deposited by means of a doctor knife.

18. A process according to claim 16 or 17, wherein the film forming coating is elastic.

19. A process according to claims 17, wherein the film forming coating consists of an aqueous dispersion of paste.

20. A process according to claims 17, wherein the film forming coating comprises between 80 and 200 g/l of cross-linkable resin, between 15 and 40 g/l of catalyst and between 20 and 30 g/l of polyvinyl acetate.

21. A process according to claim 3, wherein the film forming coating is dried and cross-linked by heating the composite base fabric in an oven.

22. A process according to claim 3, wherein the relaxation treatment consists of a thermal shock.

23. A process according to claim 22, wherein the thermal shock is achieved by means of a steam tunnel.

24. A process according to claim 3, which further comprises calendaring the composite base fabric by means of a felt calendar to flatten it.

25. A process according to claim 3, which further comprises depositing on the composite base fabric points of thermofusible copolymers after the drying and cross-linking of the film forming coating step and before the relaxation step; and heating by means of an oven the points of thermofusible copolymers whereby the points are dried and/or melted.

26. A process according to claim 25, wherein the points of thermofusible copolymers are deposited by means of a screen printing machine or photo-engraving.

* * * * *